US012678680B2

(12) United States Patent
Andry

(10) Patent No.: US 12,678,680 B2
(45) Date of Patent: Jul. 14, 2026

(54) GOLF TRAINING AID AND METHOD

(71) Applicant: Jonathan B. Andry, New Orleans, LA (US)

(72) Inventor: Jonathan B. Andry, New Orleans, LA (US)

( * ) Notice: Subject to any disclaimer, the term of this patent is extended or adjusted under 35 U.S.C. 154(b) by 392 days.

(21) Appl. No.: 17/958,103

(22) Filed: Sep. 30, 2022

(65) Prior Publication Data

US 2023/0112325 A1 Apr. 13, 2023

Related U.S. Application Data

(60) Provisional application No. 63/250,422, filed on Sep. 30, 2021.

(51) Int. Cl.
*A63B 69/36* (2006.01)

(52) U.S. Cl.
CPC ..... *A63B 69/3632* (2013.01); *A63B 2209/10* (2013.01); *A63B 2214/00* (2020.08)

(58) Field of Classification Search
CPC . A63B 60/62; A63B 69/3632; A63B 2214/00; A63B 2209/10; A47K 5/00; A47K 5/02
USPC ..... 150/160, 151; 473/256; 206/77.1; 211/85.12
See application file for complete search history.

(56) References Cited

U.S. PATENT DOCUMENTS 1,358,540 A * 11/1920 Goodwin ..... A47K 5/02 206/77.1
3,072,167 A * 1/1963 Banas ..... A63B 60/62 150/160
3,117,609 A * 1/1964 Pio ..... A63B 60/62 150/160
3,593,769 A * 7/1971 Spears ..... A63B 60/62 150/160
3,613,760 A * 10/1971 Koehnle ..... A63B 60/62 150/160
3,899,073 A * 8/1975 Barr ..... A47K 5/03 206/815
4,119,129 A * 10/1978 Freiberg ..... A63B 60/62 150/160
4,344,529 A * 8/1982 Ibarzabal ..... A47K 5/02 425/409
4,378,832 A * 4/1983 Thompson ..... A63B 60/62 150/160

(Continued)

OTHER PUBLICATIONS

Original and translation of Document ID: WO-2020083801-A1; titled "Closed and Deformable Soap Case"; with an inventor named Vicente; pp. 1-32; published Apr. 30, 2020. (Year: 2020).*

*Primary Examiner* — Sebastiano Passaniti
(74) *Attorney, Agent, or Firm* — Intellectual Property Consulting, LLC; Jared Rovira

(57) ABSTRACT

A golf swing training apparatus having a body with a first side opposite a second side and a medial region between the sides. The body is operable to receive and secure a head of a golf club. An opening defined by the body is operable to enable a hosel of a golf club to exit the body. The device may be secured to the golf club by a strip of hook and loop fastener. The device has different, highly-contrasting colors on the front and back, thereby allowing a user to receive visual cues on the alignment of the clubhead during training swings. The device is the tactile and visual part of a training method which uses color sequencing and "word" association.

1 Claim, 18 Drawing Sheets

(56) References Cited

U.S. PATENT DOCUMENTS 4,550,914 A * 11/1985 McCallister ..... A63B 69/3632 473/349
4,708,346 A * 11/1987 Pierce ..... A63B 69/3632 473/242
5,000,238 A * 3/1991 Zeller ..... A63B 60/62 150/160
5,050,655 A * 9/1991 Borenstein ..... A63B 60/62 150/160
5,230,512 A * 7/1993 Tattershall ..... A63B 69/3623 273/DIG. 30
5,403,009 A * 4/1995 Gleason, Jr. ..... A63B 69/3638 482/109
5,735,327 A * 4/1998 Aldcroft ..... B29C 63/22 150/160
6,065,516 A * 5/2000 Chang ..... A63B 60/62 150/160
6,102,810 A * 8/2000 Boland ..... A63B 60/62 150/160
6,139,442 A * 10/2000 Wilson ..... A63B 69/3614 473/260
6,419,591 B1 * 7/2002 Addeo ..... A63B 69/3638 273/DIG. 30
7,584,844 B2 * 9/2009 Kvinge ..... A63B 60/62 150/160
8,181,681 B2 * 5/2012 Shin ..... A63B 60/62 150/160
9,604,109 B2 * 3/2017 Gaffney ..... A63B 60/62
D817,023 S * 5/2018 Oliver ..... D6/536
10,406,415 B2 * 9/2019 Tabeling ..... A63B 60/62
11,911,658 B2 * 2/2024 Paulk, Jr. ..... A63B 69/3608
2002/0123389 A1 * 9/2002 Liberatore ..... A63B 21/06 473/256
2003/0170599 A1 * 9/2003 Hart ..... A63B 69/3608 434/252
2004/0016784 A1 * 1/2004 Berry ..... A45F 5/00 224/661
2004/0055904 A1 * 3/2004 Cummings ..... B65D 77/003 206/77.1
2004/0219988 A1 * 11/2004 Park ..... A63B 23/12 473/256
2005/0266929 A1 * 12/2005 Park ..... A63B 69/3632 473/219
2005/0272517 A1 * 12/2005 Funk ..... A63B 24/0003 473/222
2009/0082121 A1 * 3/2009 Clark ..... A63B 69/3623 473/218
2011/0165956 A1 * 7/2011 Park ..... A63B 60/00 473/239
2012/0034989 A1 * 2/2012 Novosel, Sr. ..... A63B 15/00 473/409
2012/0149483 A1 * 6/2012 Donahue ..... A63B 15/00 700/91
2013/0012331 A1 * 1/2013 Goldsmith ..... A63B 53/0466 473/409
2013/0165274 A1 * 6/2013 Shoaff ..... A63B 69/0059 473/409
2020/0100625 A1 * 4/2020 Gould ..... A47K 5/03
2021/0282603 A1 * 9/2021 Lin ..... A47K 5/04
2021/0386249 A1 * 12/2021 Vicente ..... A47K 5/03

* cited by examiner

GOLF TRAINING AID AND METHOD

CROSS-REFERENCE TO RELATED APPLICATIONS

This application claims priority to U.S. Provisional Patent Application Ser. No. 63/250,422, filed Sep. 30, 2021, the entirety of which is incorporated by reference as if fully disclosed herein.

BACKGROUND OF THE INVENTION

I. Field of the Invention

The present invention relates generally to a device and method intended to aid in the training and improvement of an individual's golf swing.

II. General Background

In 2019 there were approximately 24.3 million golfers in the United States and tens of millions of golfers worldwide. Golf is club-and-ball sport in which players use various clubs to hit balls into a series of 18 holes on a course. Each hole on a golf course contains three distinct areas which are a Tee Box, a fairway and a green. The Tee Box is usually elevated and is the place where a player starts the hole by teeing off or hitting the ball towards the green. The goal of the tee shot is to get the ball to land in the fairway which is the area between the tee and the hole, where the grass is cut or manicured to make it easier for the player to hit the next shot(s). The respective hole is on the "green" which is an area where the grass is cut or manicured so that the player can strike the ball with a putter to roll the ball, towards and into the hole. The goal of golf is to propel the ball from the tee box to the green and to get it in the corresponding hole. The area between the tee box and the putting green where the grass is cut even and short is called the fairway. The area between the fairway and the out-of-bounds markers, and also between a mowed apron surrounding the green and out of bounds, is called the rough; the grass there is cut higher and is often of a coarsier strain than on the fairways making the rough a disadvantageous area from which to hit.

The golf swing is the action by which the player hits and propels the ball, and each swing is counted as a stroke. The prevailing player gets the ball from the tee to the hole in as few strokes as possible. The golf swing is a complex motion involving the whole body, and it is generally agreed that a successful and consistent golf swing requires precise timing and mechanics, from the grip position of one's fingers to the position and movement of the feet.

The golf swing is an activity where proper timing and form are more instrumental than strength in achieving the desired results. The release of wrists upon impact with the ball is a natural motion that results from a proper setup, address, backswing and downswing. The wrist release in the golf swing is important because this movement generates up to seven times more clubhead speed than usual if it is executed correctly. The wrist release upon impact with the ball is a natural motion that results from a proper setup, address, backswing and downswing. The player's wrists should be square to the target when the club meets the ball.

At any moment in the swing, whether backswing, downswing, or follow through (upswing), something can go wrong that will throw off the whole body and result in a mishit. Moreover, even if a golfer's aim is correct, the ball will not hit the target if his clubface is pointed in the wrong direction on impact. For example, if the golfer's wrists do not release naturally upon impact, the clubface will be misaligned at impact, and will not transfer enough energy into the hit, resulting in a type of mishit called a slice. A "slice" is a type of unwanted, undesirable and dreaded golf shot in which the golf ball curves dramatically in flight from left to right (for a right-handed golfer) and right to left (for a left-handed golfer). While a slice can be played intentionally, it is usually the result of number of swing and/or alignment improprieties, such as an incorrect swing path and/or an incorrect wrist release. Chronic slicing is the most common problem for recreational and high-handicap golfers, as nearly 60 percent of the golfer's hit a "slice" and have an average score of 101.

The golf swing is a "motor skill", to the extent that it involves sequences of voluntary muscle contraction(s) that are conducted in a sequenced and repetitive basis towards a goal-orientated task. To acquire a skill, you first need to have a clear concept of the activity you want to perform. This is called cognitive learning or the cognitive phase. It's the same learning we did in school. It's your ability to store, recall and utilize knowledge and information. So, after you take a lesson, you have information that you will need to recall later. Motor learning, on the other hand, refers to a learner's ability to store and produce motor skills. You will see in the example below that motor learning takes hours of practice and thousands of repetitions to perform this skill under pressure during competition. This is particularly true in golf where a properly grooved swing is necessary if the player is to achieve the required degree of consistency which dictates that practicing the proper technique is of paramount importance.

Every individual undergoes three steps or stages when learning/acquiring/mastering a "motor skill". The first stage, which is called the 'Cognitive Stage', is where the individual, usually a beginner or novice, primarily focuses on what to do and how to do it. Cognitive—meaning mental process, knowing learning and understanding things. Theoretically, individuals at this Stage are attempting to cognitively understand the requirements and parameters of movements. This Stage is usually filled with numerous errors, large gains, and lack of consistency. Imagine an individual learning to swing a golf club—in the beginning, he has to concentrate very hard, attending to many, if not all, aspects of the swing. For example, an individual in this Stage is constantly evaluating the following: Hold do I hold the club? Where should my feet be? How should I move my arms? How do I time the movement? Where am I hitting to? The questions above highlight the self-talk that might be going on inside an athlete's head when learning to hit. At this stage we expect performers to be inconsistent and make many mistakes. They will also be actively taking part in problem-solving and trying to make sense of the task. The section above gives you a good idea why this stage is called the 'cognitive stage of learning'.

Once the action sequence has been determined, the individual enters the 'Associative Stage' in which attention is focused on specific details of the sequence, determining the appropriate subparts and transitions. This Stage is where performance starts to improve after and through continuous and deliberate practice. In this phase, the golfer has better consistency and incurs smaller errors because the basic fundamentals have been established and are now being refined. Performance variability naturally will decrease, in this Stage, because the individual expends a lot of conscious effort, often times focusing primarily on body movements and/or segments thereof. This Stage may require some exploration of the solution space, perhaps with one segment being overhauled to ensure that the overall action is executed in a smooth and coordinated manner.

The golfer's brain sends a signal to his muscles which fire in a sequence, with certain amounts of force at differing times to produce what he sees as the end product—his golf swing. The signal that the brain sends can be a result of what we have ingrained (myelinated) the most through repetition, or what we are consciously trying to do (swing thoughts). The hallmark of this Stage is when, through the performance of drills and the use of video and other training aids, a golfer is now associating specific cues and is managing intrinsic or kinesthetic feedback to particular parts of the motor skill. This phenomenon is known as perception-action coupling wherein the golfer is using and interpreting these cues, or kinesthetic feedback, to create what the golfer perceives to be the optimum movement.

The third stage is the 'Autonomous Stage', which is the goal of every golfer, where the skill has become automatic. The "motor skill" becomes autonomous as there is little to no conscious thought and the "motor skill" and/or portions thereof becomes nearly automatic. Self-learning, correction and refinement become huge here because individuals that have performers can detect their own errors and make the proper adjustments. While the goal of every golfer is to reach the Autonomous Stage, the overwhelming majority of golfers remain in the Associative Stage as they are constantly refining their swing, but have not yet reached the point where there is little or no conscious thought in their specific swing mechanics or the transfer of the skill to the golf course.

Color is one of the basic building blocks of visual perception and can influence memory performance by increasing attention levels and arousal. Research on memory has shown that when used, color coding/sequencing enhances the chances of environmental stimuli being encoded, stored, and retrieved successfully. Moreover, there is also considerable research that supports the assumption that increased attention to a "color feature" by an individual produces an enhanced binding of that feature and the idea that colors signal the importance of objects and/or mechanisms. As an example, the relationship and the meaning of the three colors that are used in traffic lights/signals where the green light means that it is safe to proceed or to "go"; the red light means that it is not safe to proceed and you need to "stop"; and yellow means that you need to proceed with caution. These colors and their relationship are so ubiquitous that nearly everyone unconsciously knows that RED=STOP and GREEN=GO.

Golf clubs are generally arranged into three types—Woods, Irons, and Putters. The Irons are shorter clubs with a metal club head that has a flat, angled face for striking and propelling the golf ball. There are seven irons which are sequentially numbered based on the length of the club and the degree of angle/loft of the club head. The 3 Iron is the longest and has the least amount of loft and the 9 Iron is the shortest and has the most loft. Irons are used for a variety of shots from virtually anywhere on the golf course, but are most often used to hit and propel the ball onto the green where the player subsequently can use the putter to putt the ball into the hole.

SUMMARY OF THE INVENTION

In accordance with embodiments of the invention, a golf swing training apparatus is provided. The golf swing training apparatus has a body having a first side opposite a second side. The body is operable to receive and secure a head of a golf club. An opening is defined by the body and is operable to enable a hosel of a golf club to exit the body. The first side is a first color and the second side is a second color.

In accordance with embodiments of the invention, a method of training a user's golf swing is provided. The method includes a first step of providing a golf swing training apparatus. The golf swing training apparatus has a body having a first side opposite a second side. The body is operable to receive and secure a head of a golf club. An opening is defined by the body and is operable to enable a hosel of a golf club to exit the body. The first side is a first color and the second side is a second color. The method includes a second step of securing a golf club in the body of the golf swing training apparatus wherein the first side of the body is parallel to a face of the head of said golf club and the second side is parallel to a back of the head of the golf club. The method includes a third step of swinging, by the user, as if hitting a golf ball, the golf club with the second side of the golf training apparatus facing upward and the first side facing down such that, when the golf club is swung properly, the user sees the second color of the second side immediately after when the golf club would hit a golf ball and throughout a follow through swing.

In accordance with embodiments of the invention, a golf swing training apparatus is provided. The golf swing training apparatus has a clamshell body having a first side opposite a second side. The body defines an interior. A foam portion is contained within the interior and is operable to receive and secure a head of a golf club. An opening is defined by the body and is operable to enable a hosel of a golf club to exit said body. A strap is operable to retain the body to a shaft of a golf club. The first side of the body is parallel to a face of a head of a golf club and the second side is parallel to a back of a head of a golf club when a golf club is secured within the clamshell body. The first side is a first color and the second side is a second color.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
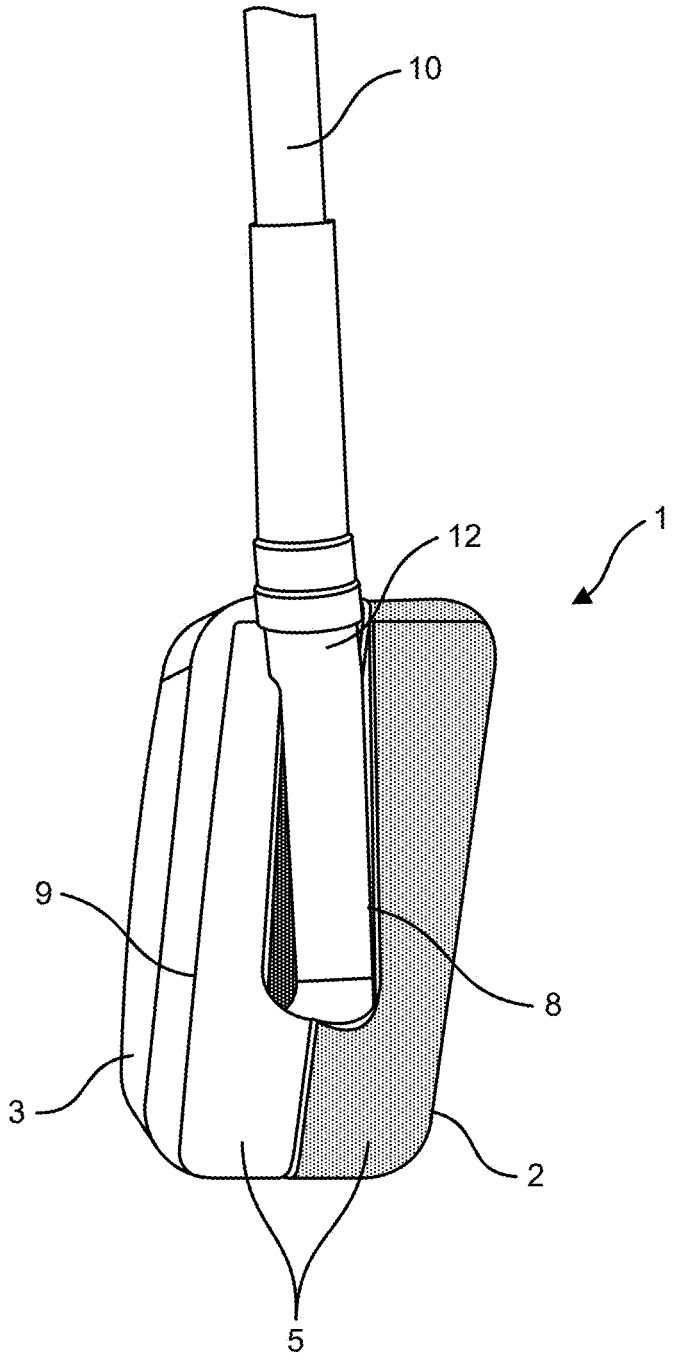
FIG. 1 depicts a side view of an exemplary embodiment of the training aid secured to a golf club.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

Despite the development of hundreds, if not thousands, of training aids and methods that are/were designed to assist golfers with ameliorating chronic slicing and/or with developing the optimum wrist release, there is still a tremendous need for a more effective solution. The present disclosure provides a comprehensive solution to at least chronic slicing and/or to learning to develop the optimum wrist-release, through the use of a device/apparatus that is attached to the player's actual club(s) in conjunction with color coding/sequencing and word association. The training aid and method, as described in the exemplary embodiments herein, uses color coding/sequencing and word/visual association to simplify the mechanics of the golf swing.

Figure 2:
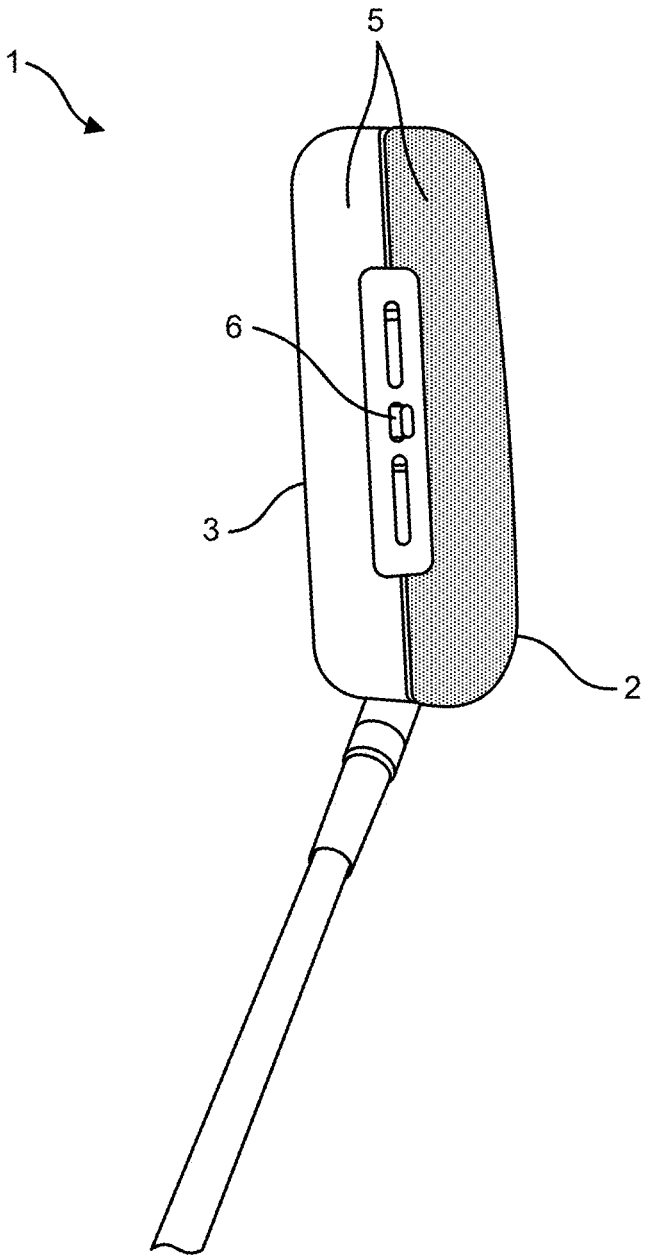
FIG. 2 depicts a top view of an exemplary embodiment of the training aid, including the different colors used on each half of the shown embodiment.
Figure 3:
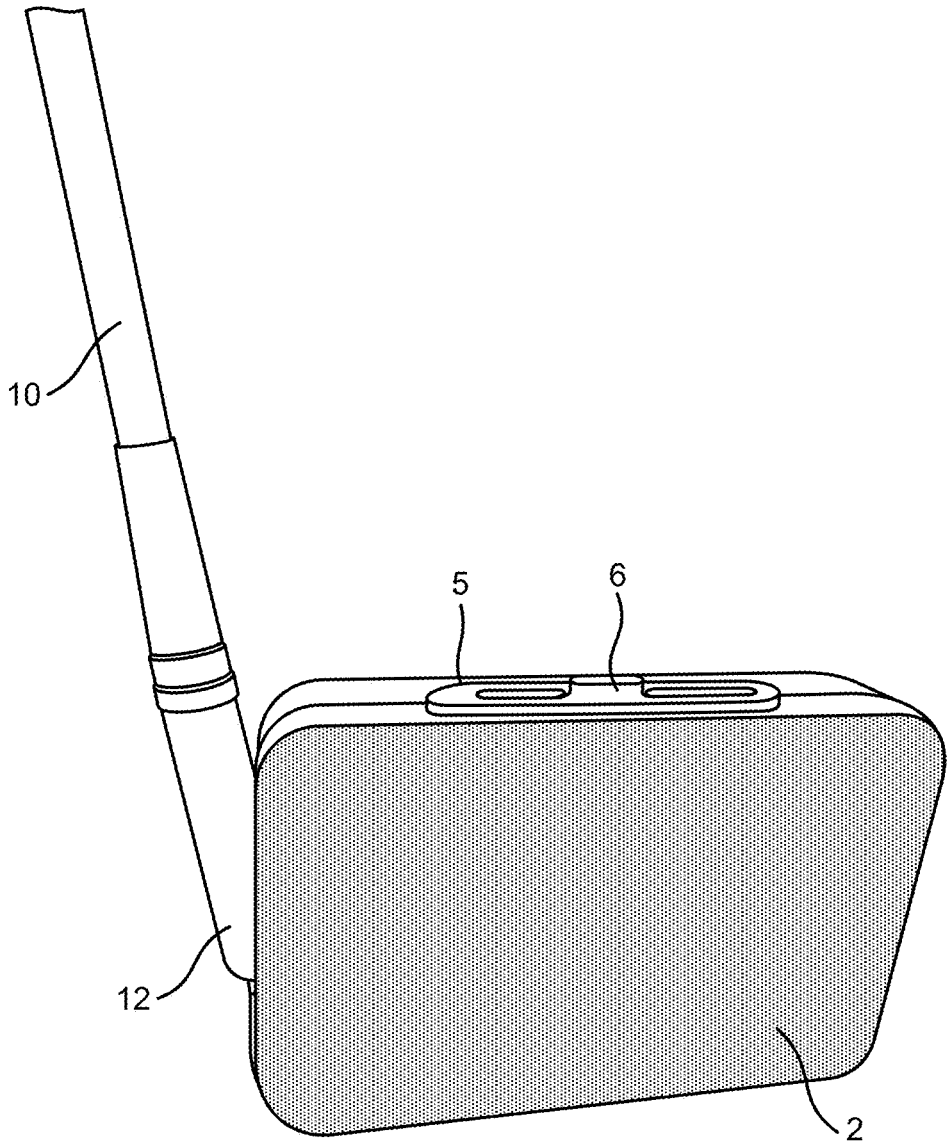
FIG. 3 depicts a rear view of an exemplary embodiment of the training aid attached to a golf club.
Figure 4:
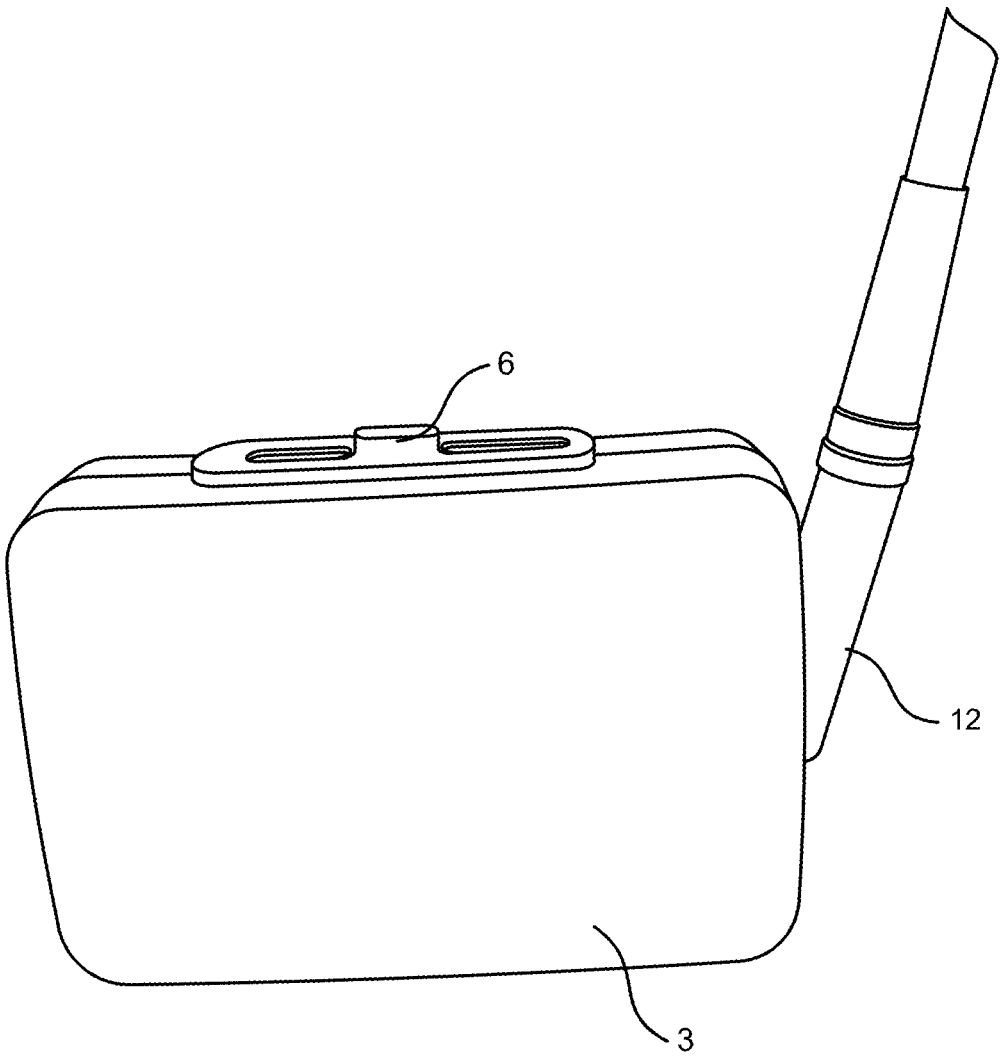
FIG. 4 shows a front view of an exemplary embodiment of the training aid attached to a golf club.
Figure 5:
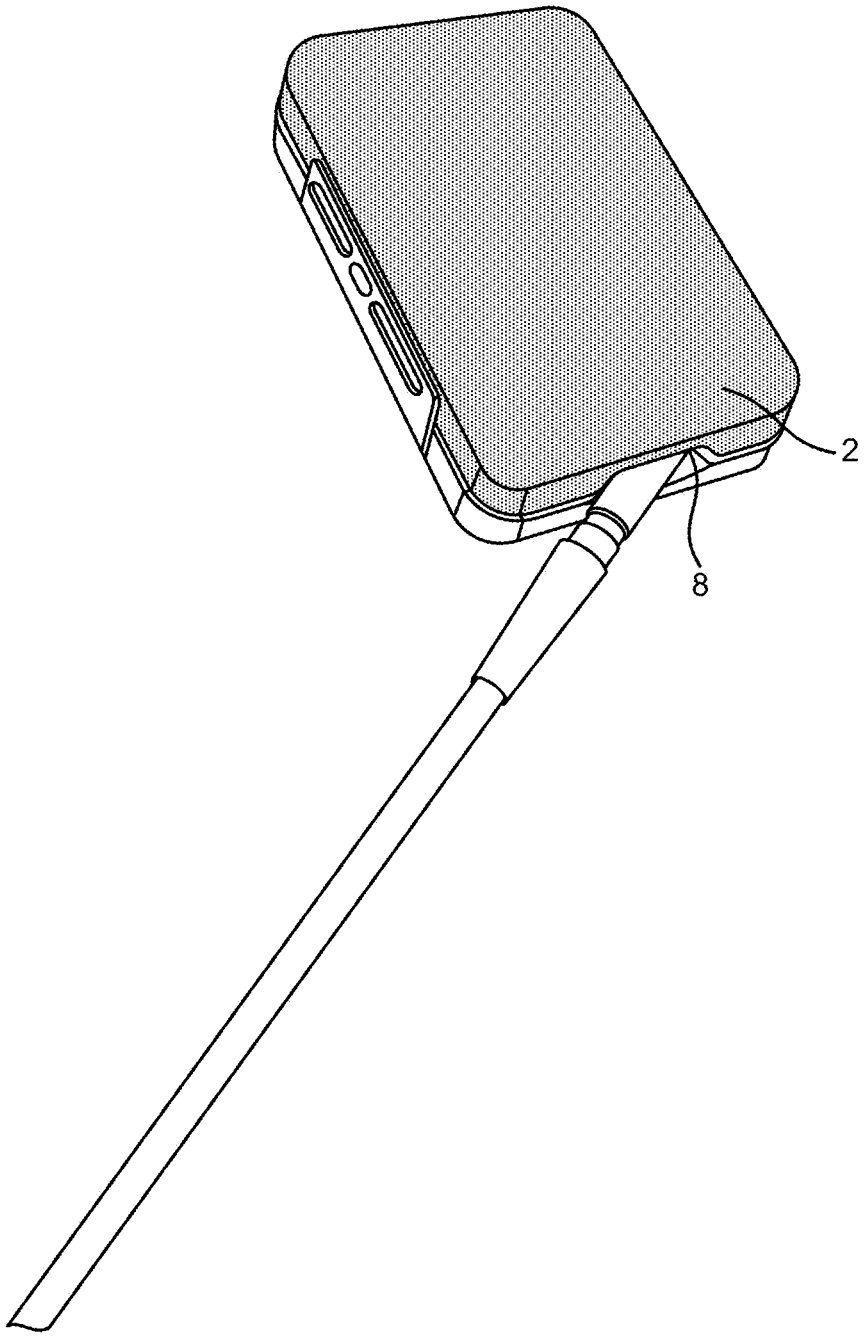
FIG. 5 shows a rear, perspective view of an embodiment of the training aid attached to a golf club, wherein this embodiment includes an alternative means of securing the aid on the club head.
Figure 6:
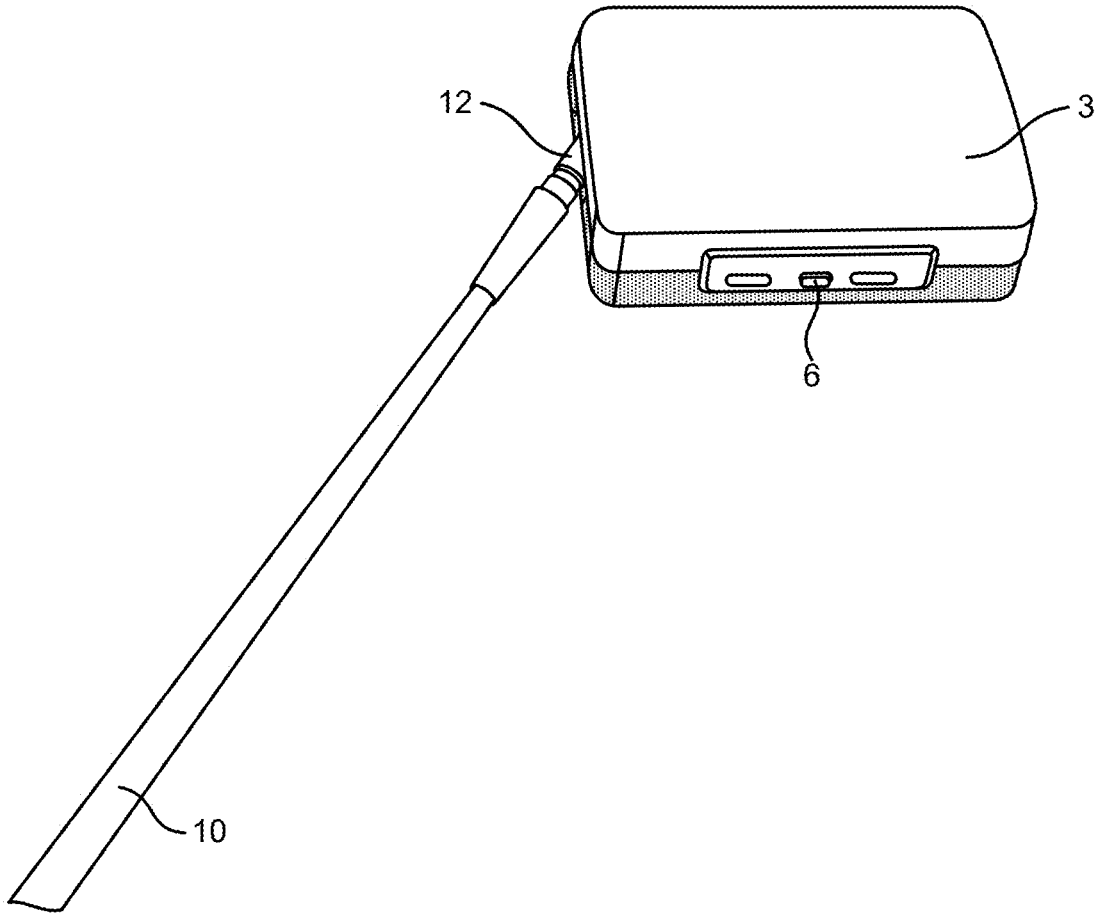
FIG. 6 shows a front, perspective view of an embodiment of the training aid attached to a golf club, wherein this embodiment includes an alternative means of securing the aid on the club head.
Figure 7:
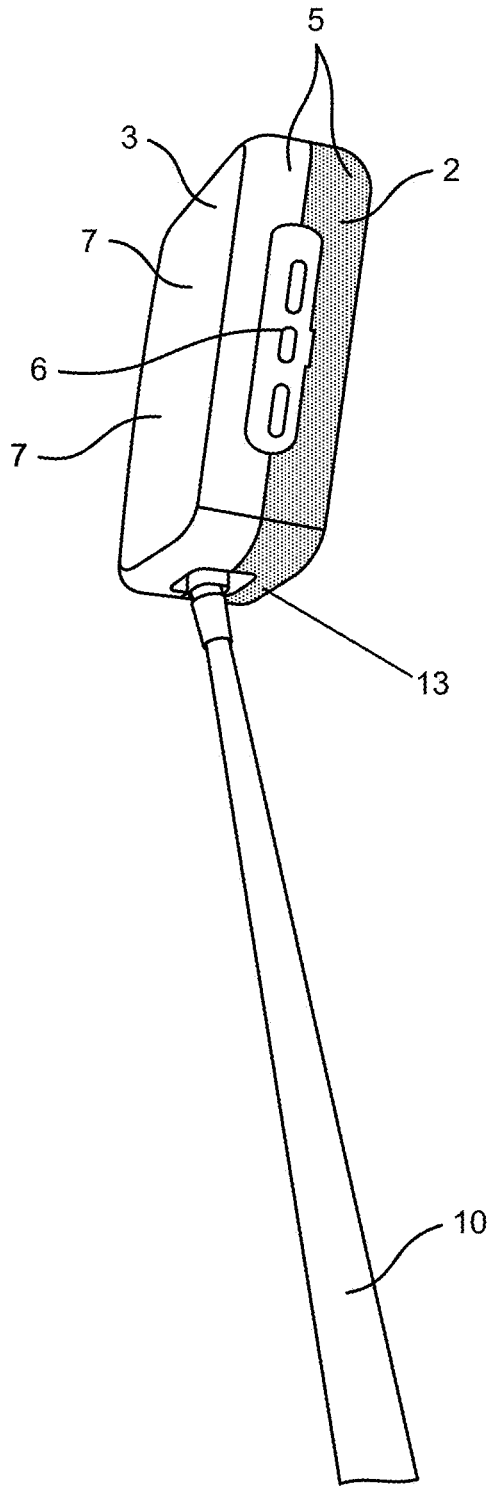
FIG. 7 shows a top, perspective view of an embodiment of the training aid attached to a golf club, wherein this embodiment includes an alternative means of securing the aid on the club head.
Figure 8:
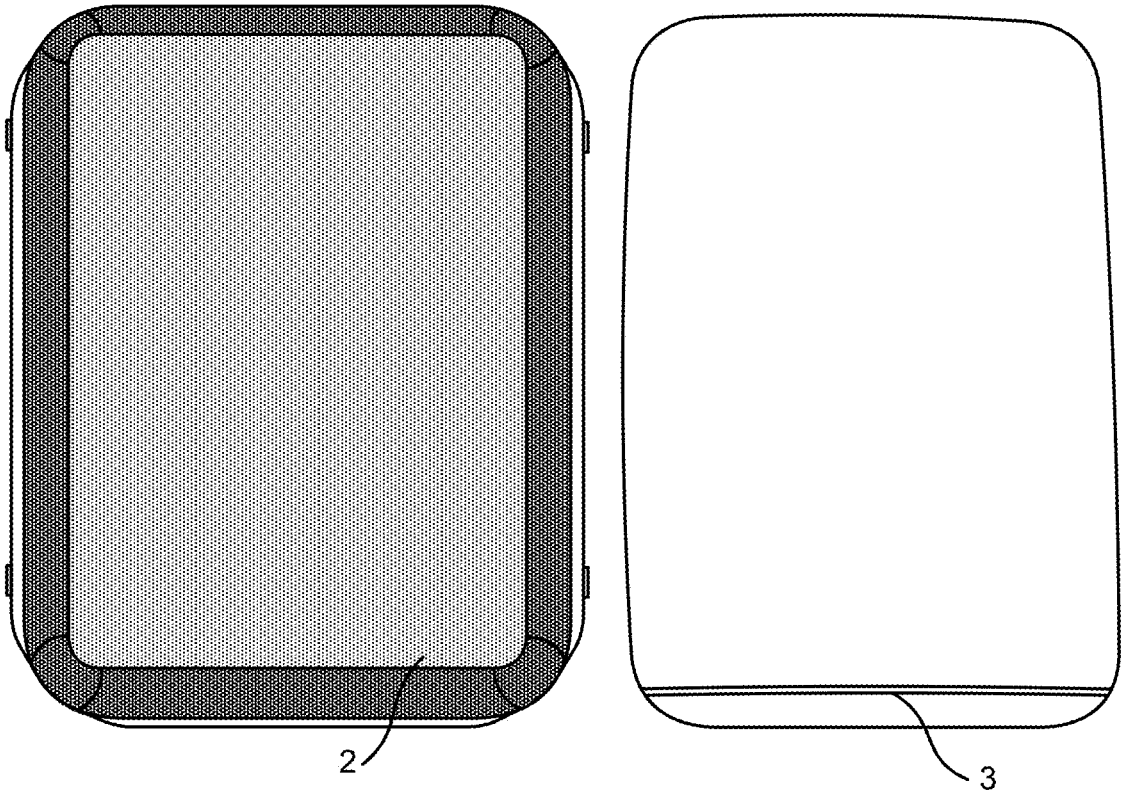
FIG. 8 shows a top view of an embodiment of the outer facing sides of the sides of the training aid in an uncoupled state.
Figure 9:
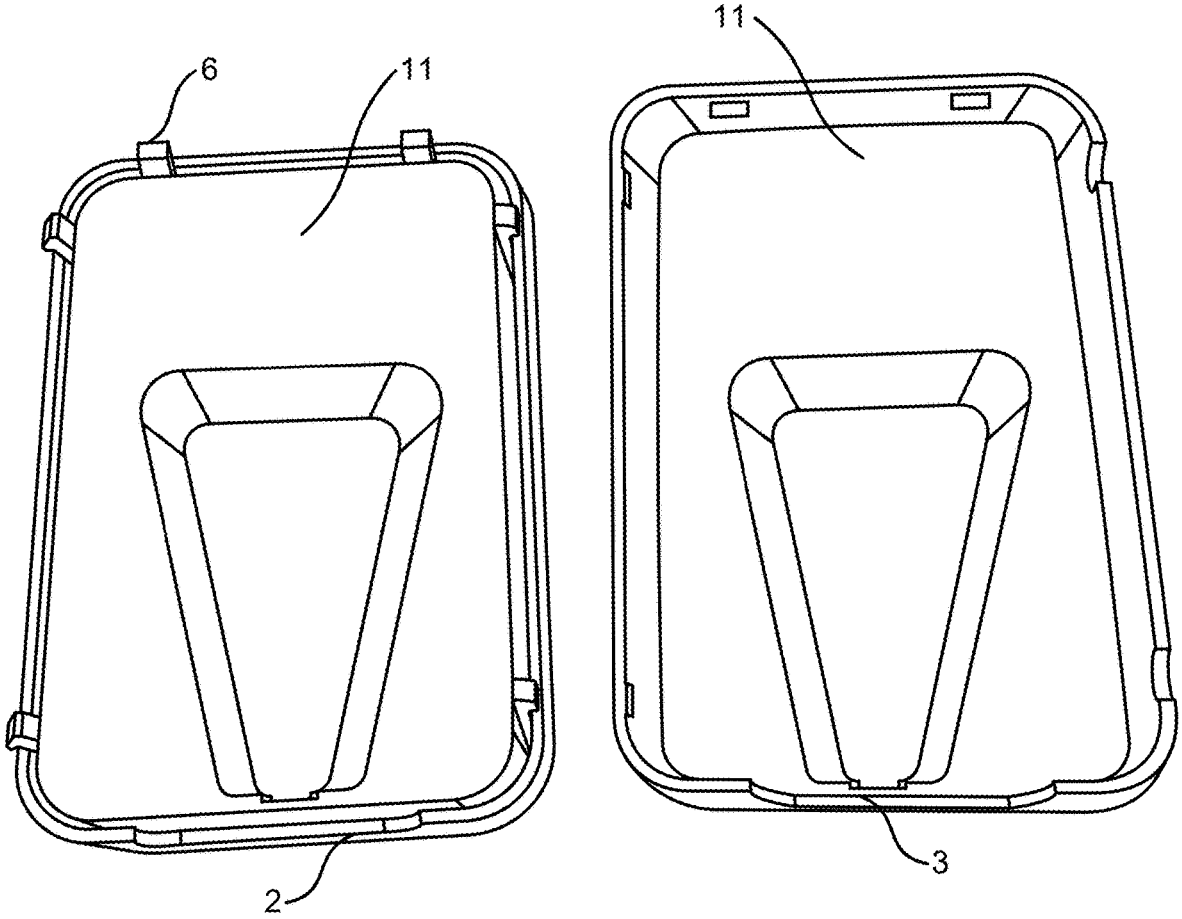
FIG. 9 shows a top view of an embodiment of the interior of the training aid in an uncoupled state.
Figure 10:
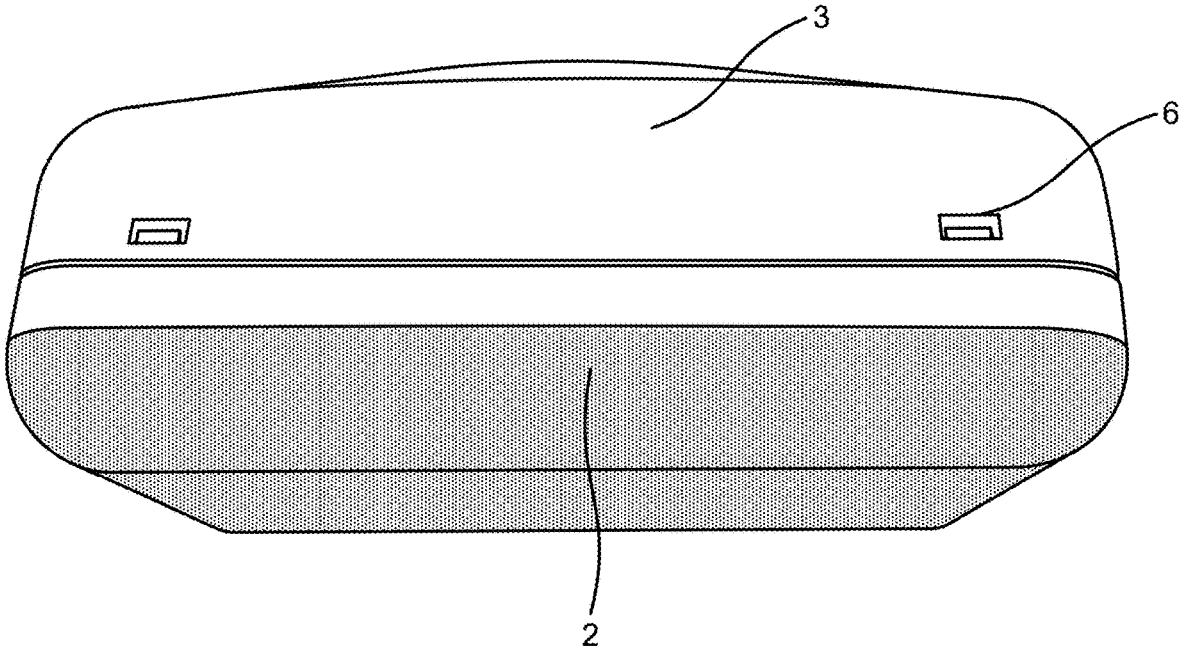
FIG. 10 shows a top, perspective view of an embodiment of the training aid.
Figure 11:
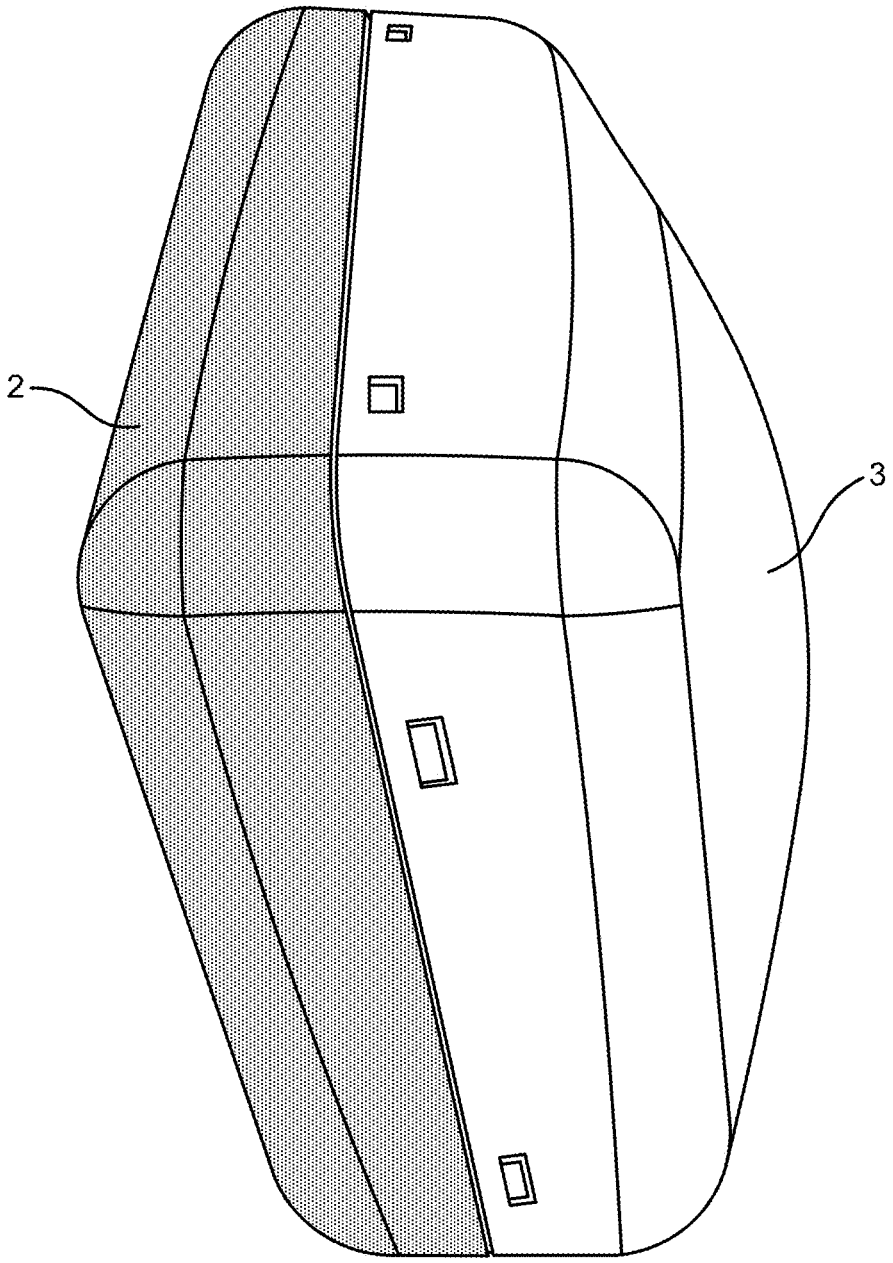
FIG. 11 shows a side, perspective view of an embodiment of the training aid.
Figure 12:
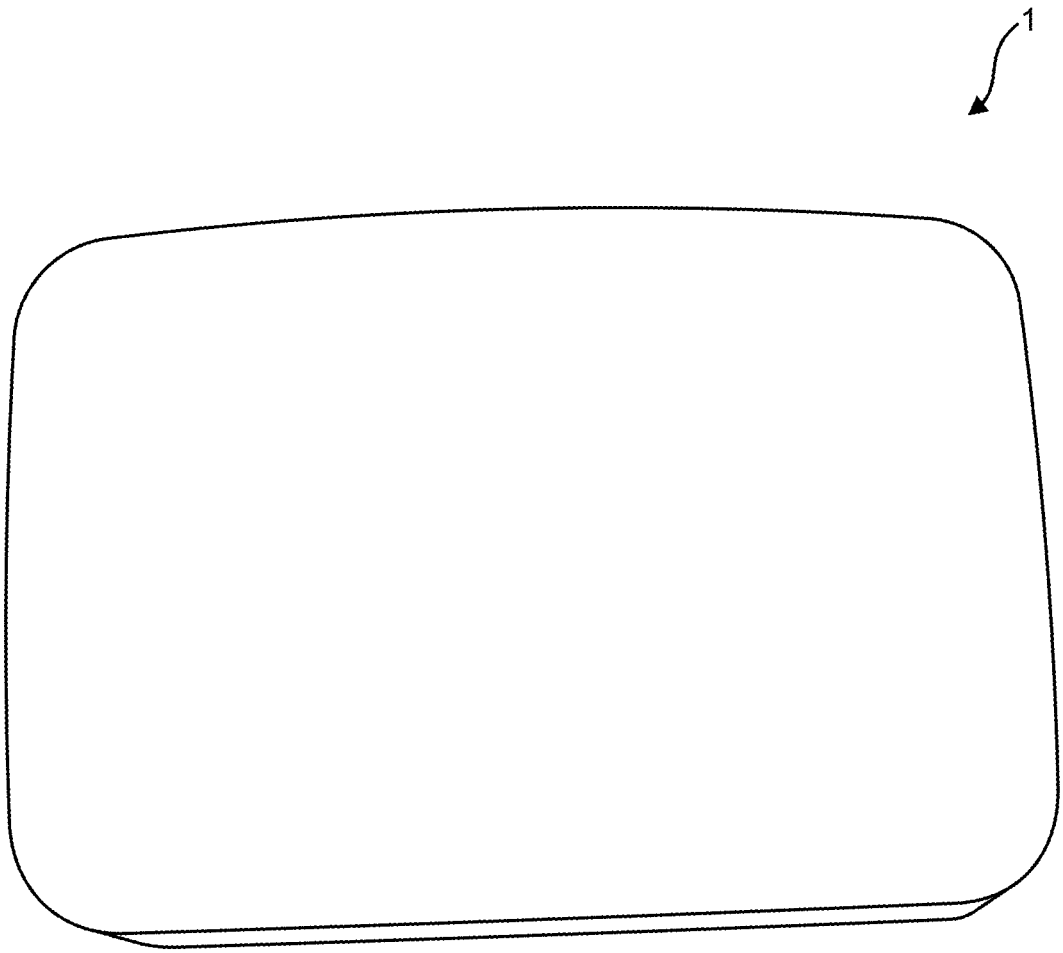
FIG. 12 shows a front view of an embodiment of the training aid.
Figure 13:
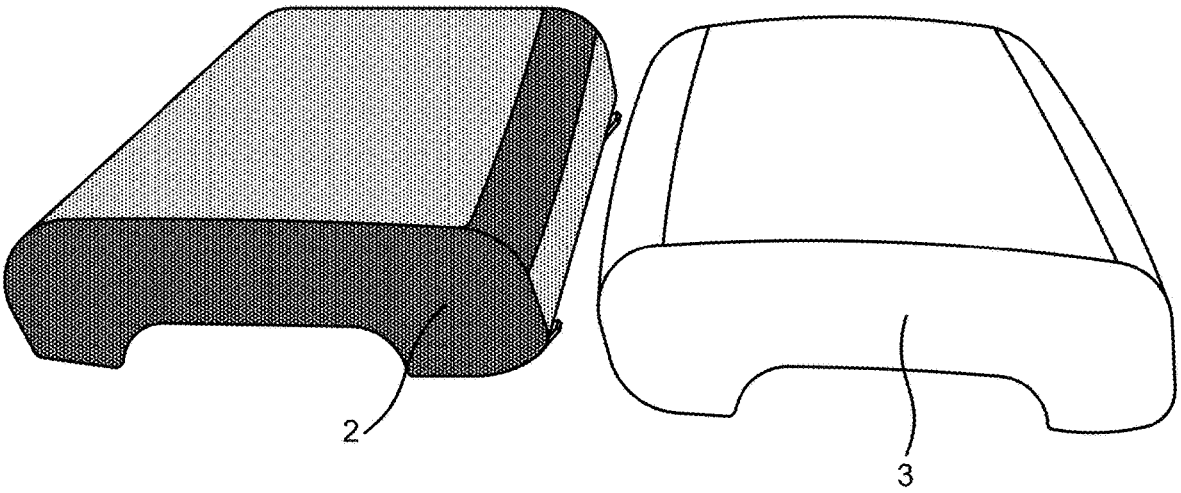
FIG. 13 shows a side, perspective view of an embodiment of the training aid in an uncoupled state.
Figure 14:
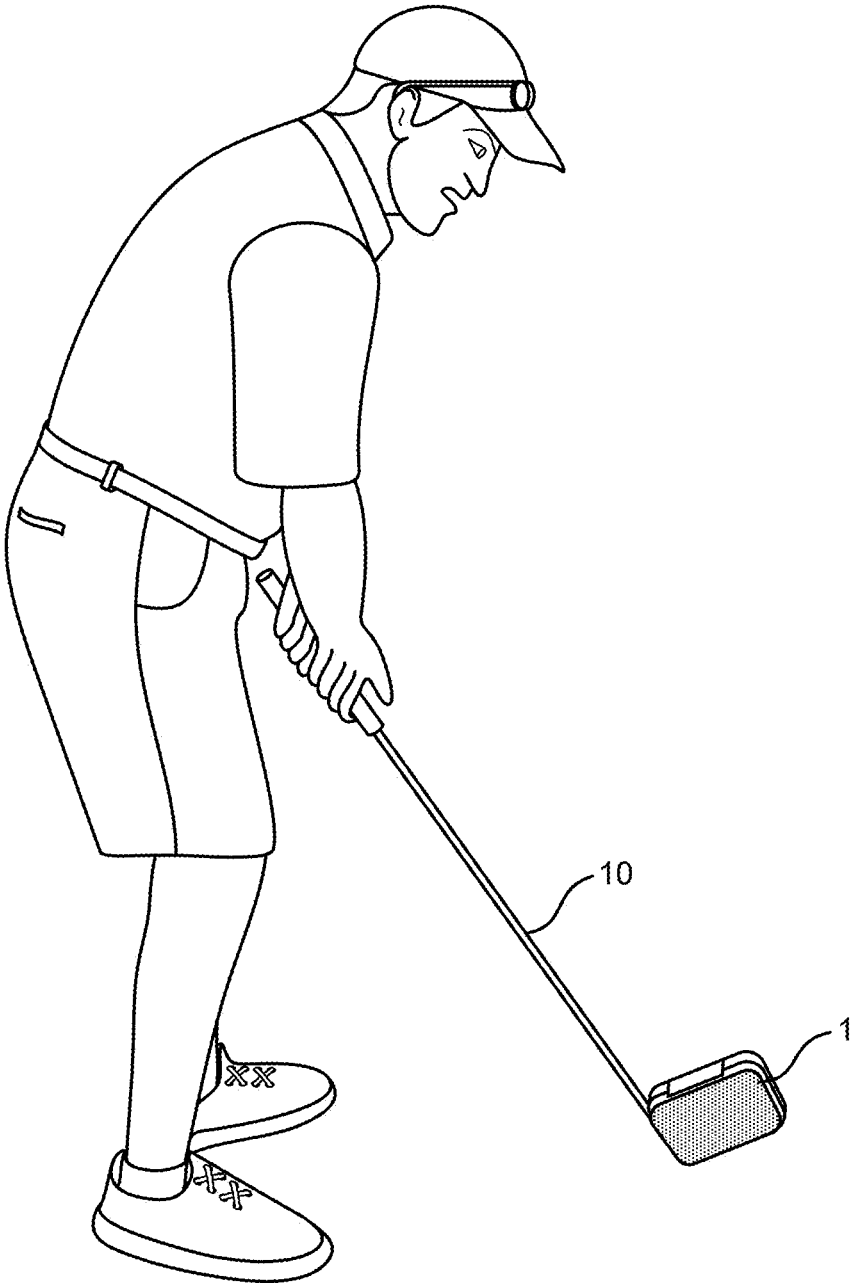
FIG. 14 shows a user holding a golf club with a training aid attached in a position as if hitting a golf ball.
Figure 15:
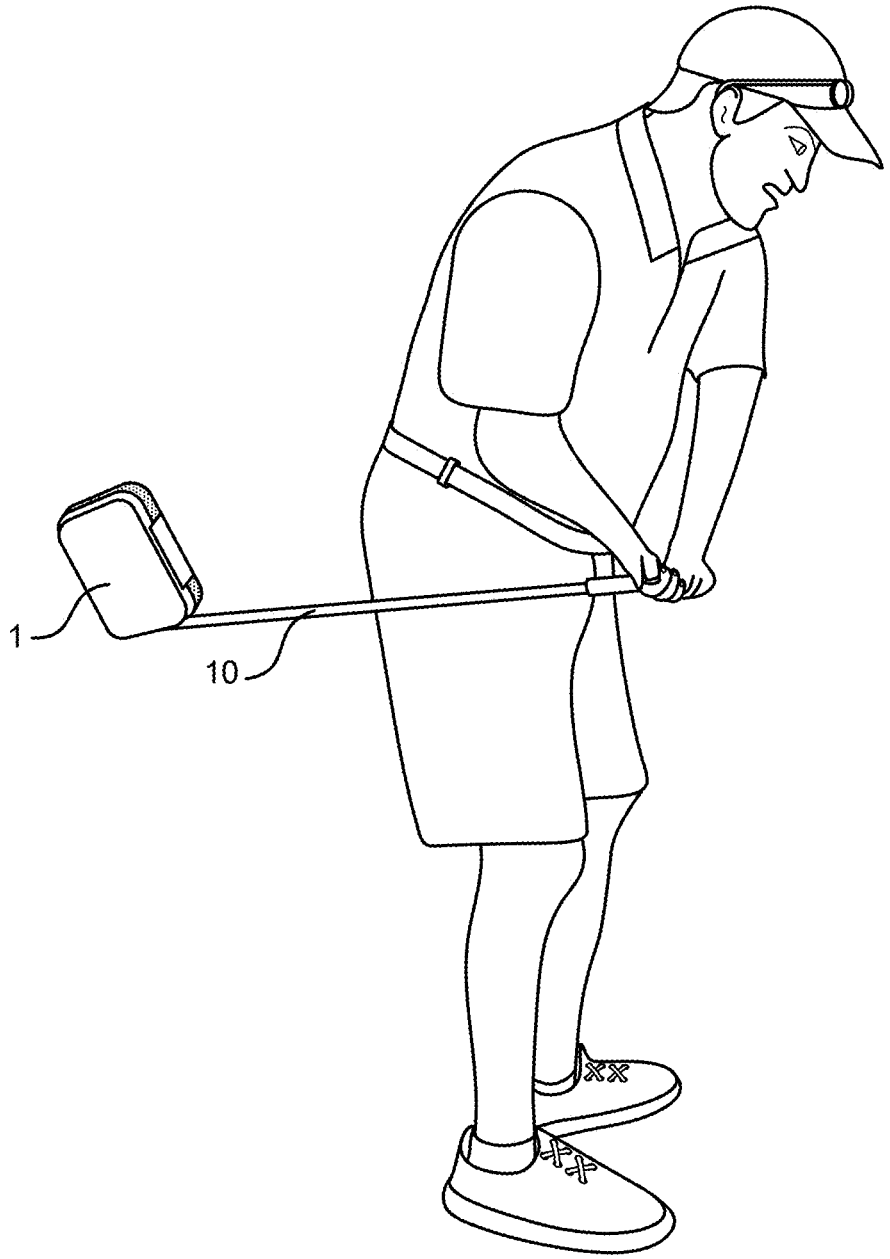
FIG. 15 shows a user swinging a golf club with a training aid attached as if hitting a golf ball.
Figure 16:
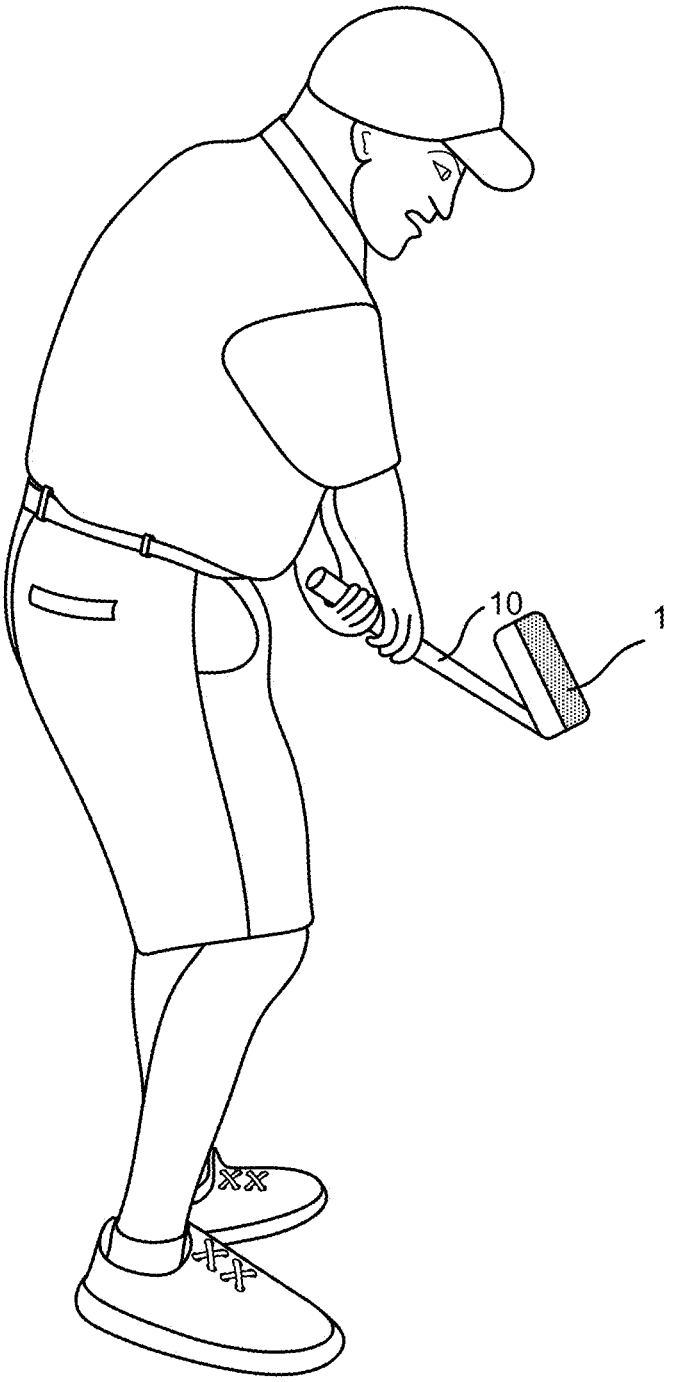
FIG. 16 shows a user's follow through after swinging a golf club with a training aid attached as if hitting a golf ball.
Figure 17:
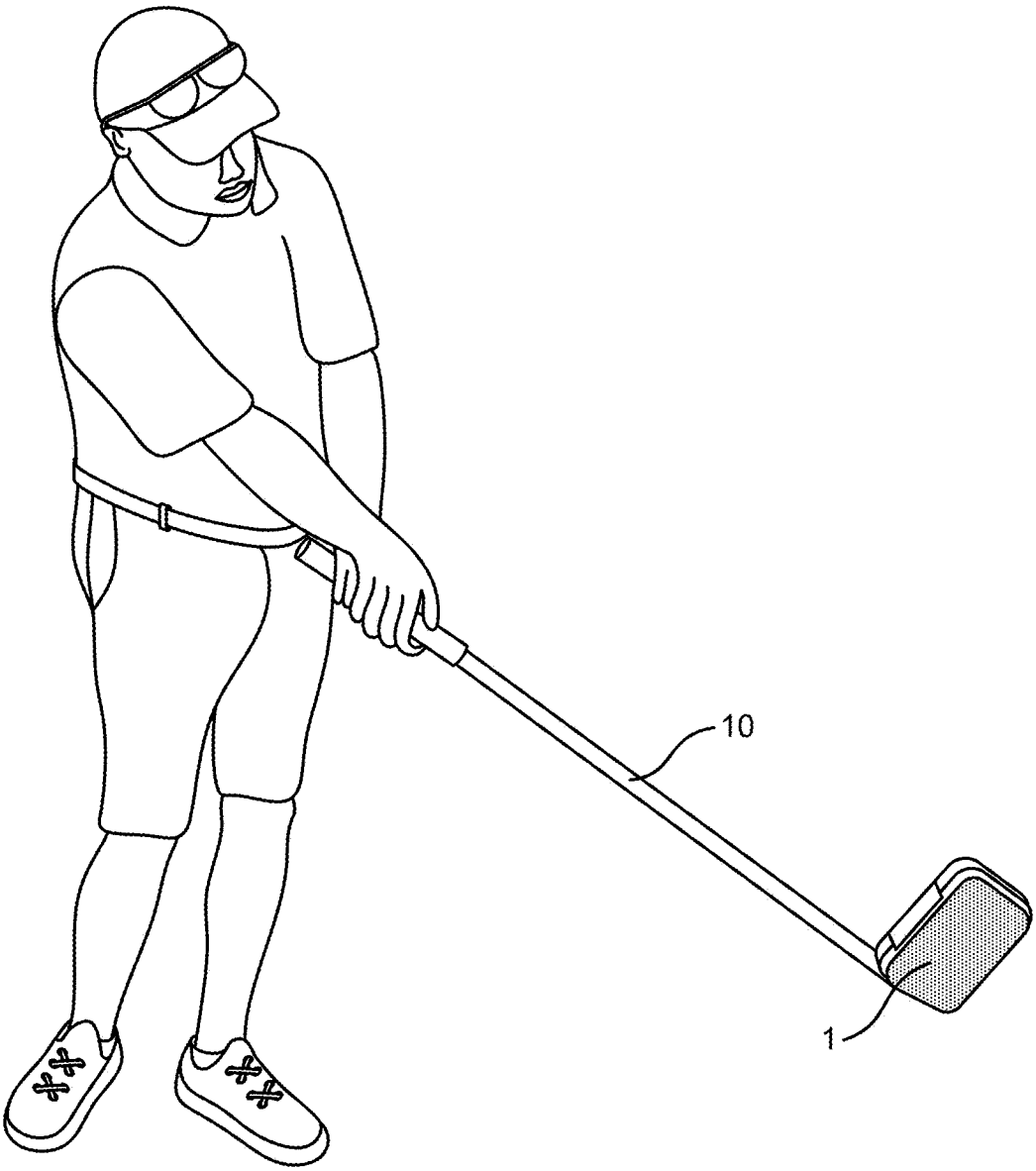
FIG. 17 shows a user's follow through after swinging a golf club with a training aid attached as if hitting a golf ball.
Figure 18:
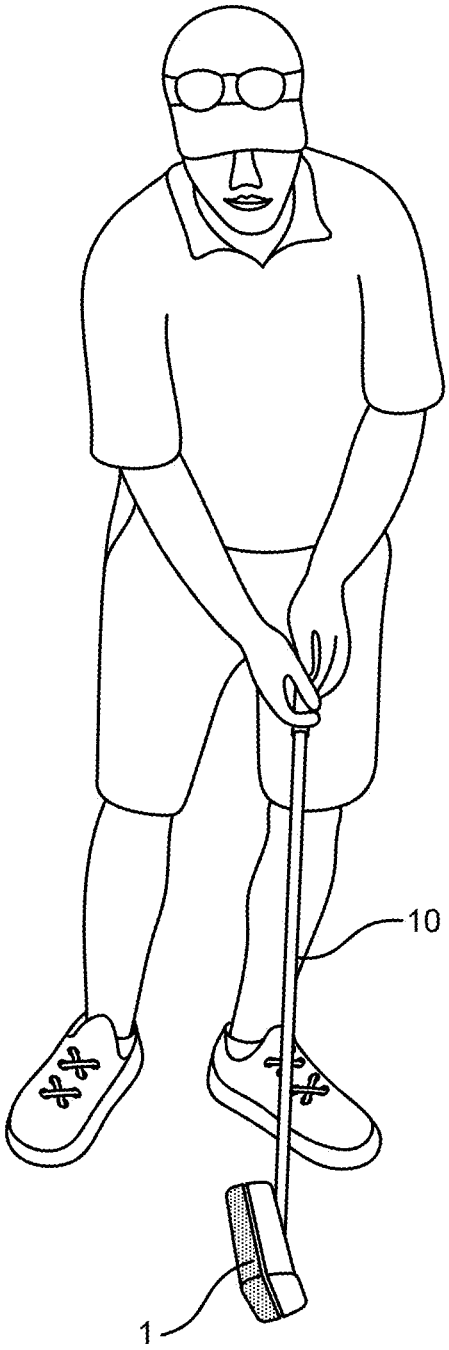
FIG. 18 shows a user holding a golf club with a training aid attached in a position as if hitting a golf ball.

In accordance with embodiments of the invention, a golf swing training apparatus 1 is provided, as illustrated in FIGS. 1-18. The golf swing training apparatus 1 has a body 9 having a first side 3 opposite a second side 2. The body 9 is operable to receive and secure a head of a golf club 10. An opening 8 is defined in a fourth side 13 of the body 9 and is operable to enable a hosel 12 of a golf club 10 to exit the body 9. The first side 3 is a first color and the second side 2 is a second color. In one embodiment, first color is red and said second color is green, as these are commonly understood as stop and go, respectively. As will be explained in more detail below, the apparatus and methods described herein are intended to direct a user's attend to look for the second color when swinging the golf swing training apparatus 1. When the second color is green, the strong association with go assists with training the user to look for the green color. The body 9 includes a medial region 5 between the first side 3 and the second side. The medial region 5 may be a third color, such as yellow, for example. As illustrated in FIGS. 1-7 and 14-18, the golf swing training apparatus 1 is a hard plastic clamshell operable to open and close by a hinge with a conforming foam interior. As illustrated in FIGS. 8-13, the golf swing training apparatus 1 is made from hard plastic operable to be coupled by clips 6. The front side 3 is convex to discourage and prevent users from hitting golf balls with the apparatus 1. The foam may be a flexible material operable to receive and fixedly surround a head of a golf club 10 disposed in an interior 11 of the body 9, for example. In another embodiment, the golf swing training apparatus 1 is a unitary body. In an embodiment where the golf swing training apparatus 1 is a unitary body, body 9 may comprise a flexible material operable to fit over and around a head of a golf club 10 and fixedly remain attached thereto via the elasticity of the body 9. In one embodiment, the golf swing training apparatus 1 is substantially rectangular, having dimensions of six inches in length by four inches in height by three inches width.

In accordance with embodiments of the invention, a method 20 of training a user's golf swing is provided. The method 20 includes a step 22 of providing a golf swing training apparatus 1. The method 20 includes a second step 24 of securing a golf club 10 in the body 9 of the golf swing training apparatus 1, wherein the first side 3 of the body 9 is parallel to a face of the head of the golf club 10 and the second side is parallel to a back of the head of the golf club. The method includes a third step 26 of swinging, by the user, as if hitting a golf ball, the golf club 10 with the second side 2 of the golf training apparatus 1 facing upward and the first side 2 facing down such that, when the golf club 10 is swung properly, the user sees said second color of the second side 3 immediately after when the golf club 10 would hit a golf ball and throughout a follow through swing. Exemplary swing positions are illustrated in FIGS. 14-18.

In one embodiment of step 24 of the method 20, the golf training apparatus 1 is secured to the golf club 10 via a strap 4, which may be hook and loop, for example.

In one embodiment of step 26 of the method 20, the user aligns the first face 2 of the golf training apparatus 1 perpendicular to a target line and where a golf ball is normally set up for a swing.

In one embodiment of step 26 of the method 20, the user swings a three-quarter backswing and subsequent follow through at half a speed of said user's normal swing.

In one embodiment, the apparatus 1 is a two-part apparatus comprised of a rectangular clamshell that has a hard plastic exterior surface with a pliable foam on the interior surface, in addition to a strip 4 of 1" wide hook and loop fastener (e.g., Velcro®) that has a loop/eye on one end. The apparatus 1 is to be affixed/attached to the club head and shaft of an Iron-type golf club 10. Once attached, the apparatus 1 provides the visual and tactile part of the training method that allows/teaches the golfer to subconsciously achieve an arcuate swing path and to release his wrists at the correct/optimum time to return the clubface to the proper alignment at impact results in more accurate and longer golf shots. The training aid and method employs color coding/sequencing and word/visual stimuli to simplify the requisite mechanics of the golf swing through perception-action coupling.

In one embodiment, the present invention comprises an apparatus 1 operable to fit snuggly over the club head of an Iron-type golf club 10. Traditional iron-type golf club heads include a face, a back, a hosel and a topline. The apparatus is tricolored such that when assembled, the anterior or front-facing side 3 is colored red, the posterior or rear-facing side 2 is colored green and the resulting medial surfaces 5 are colored yellow.

In an exemplary embodiment, the apparatus 1 comprises a hard plastic piece with hinges (not shown) located along its centerline, such that it is capable of folding over the clubhead of an Iron-type golf club 10, and attaches to itself, thereby creating a rectangular (cuboidal) block that fits over the clubhead of an Iron-type golf club. In this embodiment, the red colored portion 3 of the apparatus corresponds to and is to be placed over the face of the club head of the Iron-type golf club 10 and clipped together via clip 6 with the anterior face 2 clipped over the raised tabs on posterior face. The posterior or rear-facing face 2 may also include a depiction of a flagstick and flag that is similar to the flag sticks and flags that seen/found on each hole of every golf course. In this embodiment, the interior of the apparatus 1 is comprised of pliable foam such that the apparatus 1, when secured around the head of the golf club 10, will fit firmly against the clubhead. It is contemplated that this apparatus can be used on and will work on one or more of an individual's Iron-type golf clubs.

In alternative embodiments, the apparatus may comprise a single, unitary body with an opening 8 capable of receiving the head of an Iron-type club head. In some embodiments, one or more straps (see, e.g., straps 4 or 7) or other attachment means may be employed to fix the apparatus in place once it is fitted over the club head. In another alternative embodiment, the apparatus is comprised of a flexible material and is thus capable of fitting over and around the club head and fixedly remaining attached thereto either via the elasticity of the apparatus itself or via one or more straps, ties, or other means of fixing the apparatus in place.

In use, the individual should first place the apparatus onto the club head of an Iron-type golf club. When the apparatus is properly and securely attached there is an opening 8 for the hosel/shaft 12 of the respective golf club 10. Next, the individual should place/put the eye/loop of the strip of hook and loop fastener 4 over the grip and down the shaft of the respective golf club till the eye/loop is aligned with the top of the apparatus 1 as it is attached/affixed to the club head. Then, the individual should wrap the other end of the strip of hook and loop fastener 4 around the top of the apparatus 1 and back around the loop/eye and onto itself so that the apparatus is securely attached/affixed/fastened to the club head of the respective Iron-type golf club. Once it is properly attached the red face 3 of the apparatus is parallel to the face of the club head, the green face 2 of the apparatus is parallel to the back of the club head and all of the medial surfaces 5 are yellow. These colors were used because they are the universally known. In alternative embodiments, other means of fastening might be employed, including: elastic bands, buckled straps, tie-on straps or strings, etc. In one embodiment, straps 7 serve to hold apparatus 1 in place around the club head of club 10.

After affixing/attaching the apparatus to the club head and securing it with the strip of hook and loop fastener (or equivalent fastening means), the individual can begin using it as a training aid consistent with the training method, which incorporates/employs color coding/sequencing strengthened by "word" and association. The training method is comprised of a sequence of specific actions. At the outset, the individual should set up as if he were going to hit a golf ball, with the red face of the apparatus aligned perpendicular to the golf ball and target line. The device is not designed and should not be used to actually hit a golf ball. In the embodiments illustrated in FIGS. 8-13, first side 3 is convex to discourage hitting a ball, as the surface is not conducive to hitting a ball. Instead, the training method provides for him to conduct a three-quarter backswing and subsequent follow through at half the speed of his normal swing. When performed correctly, the training method dictates that the individual will be able to maintain eye contact with the second face of the apparatus immediately after impact and throughout his follow through. When the second face of the apparatus is green, as an example, users are familiar with green representing, good, go, or an affirmative result of some activity. The color green also has a strong association with golf, as the user is aiming to hit a ball toward the green. As to "word" association, as the user repeatedly trains with a device and is seeking to see the second color on the second face when the method dictates to train for the proper swing, the user will develop and associate terms to describe the views. For example, a user might say "green up" to describe when the green second side should be visible, as a swing when the green side is likely not proper form. By repeating the sequence of actions and words with the apparatus, the individual should, over time, unconsciously associate the pattern of his swing with the movement of the respective colors and unconsciously recognize that he should see the same color, such as green, on the second side 3 of the apparatus after impact and throughout his follow through. This motion and sense of direction teaches the user of the device to make a smooth, continuous swing, properly rolling the hands after striking through the ball. In this manner the swinging of the club becomes grooved and proper joint and muscular development and coordination are achieved upon repetitive use.

"Word" association as an additional factor that will be picked up in the associative phase of motor skill learning that will carry over into the associative stage. The player learns to associate a good shot when he is able to consistently view the green color on the second side on the back of the apparatus. The phrase developed by the user-such as "green up"-ends up as a loaded phrase to the extent that it can easily be associated by the player to coincide with the actual green on the hole. As such, it causes the player to learn the complicated motor skill through color coding, "word" association and "picture" association, which is an additional factor that moves the state of the art from the invention perspective.

There are hundreds if not thousands of golf training aids and methods, the majority of which are separate and distinct from the golfer's actual swing. The golfer then has to try to adapt/translate what he may have learned through using the aid to use with his club(s) which, more often than not, is way more difficult that it sounds. The golfer's dilemma of adapting/translating what he got from the training aid, when he goes out to the course and has to deal with other players, frustration from prior mishits, course conditions, etc. The present disclosure all but eliminates the golfer's need to adapt/translate since the device is attached to his golf clubs. As such, the golfer unconsciously develops, through perception-action coupling, a link between the colors and wording of the device and his swing.

The following is an illustrative example of how the training aid and method improves the state of the art. A golfer meets up with the club pro at the driving range for a lesson on how to hit a 150 yard approach shot. He gets good pointers regarding the specific mechanics of his golf swing and leaves feeling as if he has mastered the shot. Then, about a week after his lesson, a golfer goes out to the golf course and is confronted with a 150 yard approach shot. As he is standing over the ball, his head quickly becomes cluttered with a million questions. "When do I break my wrists?" "Was it weight on the left?" "Hands forward?" "Keep your head down." "Don't use your hands." At this point there is no way he will execute the desired shot, and he is confronted with the golf maxim of one ball, one shot with a consequence to every swing. His grip pressure gets tight and tension overtakes his body. The club hits the ground two inches behind the ball and his immediate reaction is anger and frustration.

This situation is drastically different with the proposed disclosure. The same golfer practices with his 7 iron and the training aid and method. Then, about a week later, he goes out to the golf course and is confronted with the same 150 yard approach shot. He addresses the ball with the same 7 iron and is focused on one thought-see the color on the second side 3 of the golf swing training apparatus. He takes his backswing and unconsciously visualizes the apparatus over the club head, keeping the red face towards the ground. Then, he swings and follows through, unconsciously releasing his wrists at the optimum time so that he can see the color on the second side of the golf swing training apparatus. The clubhead strikes the ball perfectly, the ball travels 150 yards and lands on the green.

An objective of this disclosure is to simplify the golf swing through color sequencing and "word" association. From the downswing, through the turning of the hands in the proper direction to the follow through in a smooth, arcuate motion. In this way the disclosure acts as a training tool—aid and a methodology—orienting the user to the proper sense of direction the hands must follow in the application of the actual swinging of a golf club, while at the same time conditioning the individual's mind to become aware of the full range of motion of the swing, including the turning of the arms and wrists in sequential harmony. After repeated practice with the disclosed apparatus and method, the golfer unconsciously develops a grooved golf swing by and through envisioning the correct color sequence, such that he can see the color on the second side of the golf swing training apparatus throughout the follow through. The golf swing is simplified to the point where it becomes see the color on the second side of the golf swing training apparatus, which is easy for the golfer to imagine and subconsciously reproduce.

In the embodiment illustrated in the Figures, the training aid and method is comprised of a hard plastic device that is attached/affixed to an individual's Iron-type golf clubs and is secured by a strip of hook and loop fastener. Said hard plastic device is approximately six inches in length by four inches in height by three inches width, and has a hard plastic exterior with a conforming foam interior. Said device is a clamshell that folds over the clubhead and snaps on itself. The device is secured to the golf club by a strip of hook and loop fastener that the individual slides over the shaft of the club then wraps around the device and back over itself around the shaft. The device has different, highly-contrasting colors on the front and back, thereby allowing a user to receive visual cues on the alignment of the clubhead during training swings. The device is the tactile and visual part of a training method which uses color sequencing and "word" association.

The device also helps to ensure an arcuate swing which will lead to more consistent swings and better ball striking. The definition of arcuate is curved or bow like. The concept of an arcuate swing is a nice circular swing that is fluid, and circular. The arcuate swing is the goal of a golfer because it ameliorates choppy swings where the club is driven into the ground before the ball (a "fat" hit) or the club impacts the ball above its equator (a "thin" shot). As such, the player learns or associate seeing the green with consistent ball striking, which makes him more likely to replicate a good shot with good results.

In addition to the foregoing, applicant suggests that the disclosed apparatus and method provide the following benefits and advantages:

- The disclosure assists the golfer with returning the club face to the proper alignment and position at impact;
- The disclosure increases the subconscious adoption of the training method because the device is attached/affixed to the golfer's actual clubs;
- The disclosure increases and heightens the golfer's perception-action coupling through the use of color sequencing/coding;
- The disclosure increases and heightens the golfer's perception-action coupling through the use of "word" and "picture" association;
- The disclosure increases and heightens the golfer's perception-action coupling through the use of the combination of color coding/sequencing and "word" and "picture" association;
- The disclosure assists the golfer by allowing him to develop the requisite "muscle memory" of the path that leads to proper club face alignment at impact through color sequencing/coding;
- The disclosure assists the golfer by allowing him to develop the requisite "muscle memory" of the path that leads to proper club face alignment through "word" and "picture" association;
- The disclosure assists the golfer by allowing him to develop the requisite "muscle memory" of the path that leads to proper club face alignment through the combination of color sequencing/coding and "word" and "picture" association;
- The color coding and "word" association educates/allows the golfer to subconsciously develop the requisite "muscle memory" to repeatedly produce an arcuate swing path which produces the proper alignment of the clubhead at impact;
- The disclosure allows/teaches the user to develop/form the requisite "muscle memory" for the proper wrist release at the optimum time to produce the proper club face alignment at impact through color coding/sequencing;
- The disclosure allows/teaches the user to develop/form the requisite "muscle memory" for the proper wrist release at the correct time to produce the proper alignment of golf club at impact through "word" and "picture" association;
- The disclosure allows/teaches the user to develop/form the requisite "muscle memory" for the proper wrist release at the optimum time to produce the proper alignment of golf club at impact through the combination of color coding/sequencing and "word" and "picture" association;

The disclosure educates the forearms to simply roll, which squares the face and provides for an on-plane delivery which eliminates the "pulling" the club down, spinning the face open, and throwing the club across the plane;

The use of the combination of color coding/sequencing and "word" and "picture" association heightens the user's perception-action coupling which teaches/allows the user to subconsciously develop and master complicated swing movements and timing; The use of the color coding/sequencing heightens the user's perception-action coupling which teaches/allows the user to subconsciously develop and master complicated swing movements and timing;

The use of the combination of color coding/sequencing and "word" and "picture" association heightens the user's perception-action coupling which teaches/allows the user to subconsciously develop and master complicated swing movements and timing; and The disclosure teaches the user, through the combination of color coding/sequencing and "word" and "picture" association to automatically make the proper motion (subconscious brain) instead of manually (conscious brain).

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A golf swing training system, comprising:

a golf club having a head, the head comprising a face, a back, a hosel, and a topline; and a golf swing training apparatus comprising:

a generally rectangular cuboidal body having at least a first side, a second side, a third side, and a fourth side, the body being configured to securely enclose the head of the golf club;

wherein the first side comprises a convex face surface;

an opening defined in the fourth side of the body, the opening being configured to allow the hosel of the golf club to exit the body when the head is enclosed;

wherein the fourth side and the opening are oriented toward a user when the user is holding the golf club in an address position prior to a swing with the apparatus secured thereto;

wherein when the apparatus is secured to the head of the golf club:

the first side of the body comprises a first color on a majority of an outer surface of the first side and covers the face of the golf club head and thereby presents a first color correlating to the face of the golf club head;

the second side of the body comprises a second color on a majority of an outer surface of the second side and covers the back of the golf club head and thereby presents a second color correlating to the back of the golf club head; and the third side of the body comprises a third color on a majority of an outer surface of the third side and covers the topline of the golf club head and thereby presents a third color correlating to the topline of the golf club head;

wherein the first, second and third colors are configured to provide a user with visual feedback during a golf swing based on an orientation of the golf club head;

wherein the first color, the second color and the third color are each different colors.

* * * * *